US005774104A

United States Patent [19]

Crossland et al.

[11] Patent Number: 5,774,104

[45] Date of Patent: Jun. 30, 1998

[54] CO-ORDINATE ADDRESSING OF LIQUID CRYSTAL CELLS

[75] Inventors: William Alden Crossland, Harlow; Martin John Birch, Teddington, both of United Kingdom

[73] Assignee: Northern Telecom Limited, Montreal, Canada

[21] Appl. No.: 739,811

[22] Filed: Oct. 30, 1996

Related U.S. Application Data

[63] Continuation of Ser. No. 363,573, Dec. 22, 1994, abandoned, which is a continuation of Ser. No. 984,426, Mar. 24, 1993, abandoned.

[30] Foreign Application Priority Data

Sep. 11, 1990 [GB] United Kingdom ..... 9019883
Sep. 11, 1991 [GB] United Kingdom ..... 911536

[51] Int. Cl.[6] ..... G09G 3/36

[52] U.S. Cl. ..... 345/96; 345/97; 345/209

[58] Field of Search ..... 345/7, 94, 96, 345/97, 99, 87, 147, 148, 149, 209; 359/56, 57

[56] References Cited

U.S. PATENT DOCUMENTS 4,705,345 11/1987 Ayliffe et al. ..... 345/97
4,927,243 5/1990 Taniguchi et al. ..... 345/97
5,041,823 8/1991 Johnson et al. ..... 345/94
5,220,314 6/1993 Mano et al. ..... 345/98
5,408,248 4/1995 Crossland ..... 345/96

FOREIGN PATENT DOCUMENTS 0199361 10/1986 European Pat. Off. .
0371665 6/1990 European Pat. Off. .

OTHER PUBLICATIONS

PCT/US 89/05700 Johnson Jul. 1990 International Publication No. : WO 90/07768.

*Primary Examiner*—Richard Hjerpe
*Assistant Examiner*—Kent Chang
*Attorney, Agent, or Firm*—Lee, Mann, Smith, McWilliams, Sweeney & Ohlson

[57] ABSTRACT

In an active back-plane coordinate addressed liquid crystal cell whose pixels are set into one state by the application of a unidirectional potential across the thickness of the liquid crystal layer, and into the opposite state if the direction of the applied potential is reversed, refreshing is carried out in two sequential stages in order to avoid cumulative charge imbalance effects. In one stage the pixels are set to their required states, whereas in the other stage they are set to the inverse of those states.

5 Claims, 3 Drawing Sheets

CO-ORDINATE ADDRESSING OF LIQUID CRYSTAL CELLS

This application is a continuation of U.S. patent application Ser. No. 08/363,573, filed Dec. 22, 1994, now abandoned, which is a continuation of U.S. patent application Ser. No. 07/984,426, filed Feb. 24, 1993, now abandoned.

This invention relates to the co-ordinate addressing of liquid crystal cells. Co-ordinate addressing of such cells can be achieved by methods in which each pixel is defined as the area of overlap between one member of a set of row electrodes on one side of the liquid crystal layer and one member of another set of column electrodes on the other side. In an alternative co-ordinate addressing method the liquid crystal is backed by 'an active back-plane' which has a co-ordinate array of electrode pads which are addressed on a co-ordinate basis within the active back-plane, and electrical stimuli are applied to the liquid crystal layer between individual members of this set of electrode pads on one side of the liquid crystal layer and a co-operating front-plane electrode on the other side of the liquid crystal layer. Generally the front-plane electrode is a single electrode, but in some instances it may be subdivided into a number of electrically distinct regions. The active back-plane may be constructed as an integrated single crystal semiconductor structure, for instance of silicon.

This invention relates in particular to the active back-plane addressing of liquid crystal cells whose response to an electrical stimulus is sensitive to the polarity of that stimulus.

In the electrical addressing of liquid crystal cells it is generally important to ensure that no pixels are subject to any significant long term cumulative charge imbalance that could give rise to electrolytic degradation effects within the cell. In the cases of cells whose response is not polarity sensitive, long-term charge balance can often be ensured by using charge-balanced a.c. stimuli throughout, but clearly there are problems in transferring this approach to the addressing of cells whose response is polarisation sensitive because in these circumstances the application of a charge-balanced a.c. stimulus to a pixel may make it make a temporary excursion from its initial state to some other state, but is then likely to restore it once again to its initial state.

In the ensuing description any particular pixel of a co-ordinate array of pixels is identified by its row and column co-ordinates. Whereas in conventional usage of the terms 'row' and 'column', rows and columns are respectively identified as horizontally-extending and vertically-extending lines; in this instance these terms are employed in a wider sense that does not imply any particular orientation of the row and column lines with respect to the horizontal, but merely that the sets of row and column lines intersect each other.

According to the present invention there is provided a method of addressing a liquid crystal cell having a coordinate array of pixels wherein data for refreshing the cell is applied at each refreshing in two sequential stages in one of which the pixels are individually set to their required states and in the other of which they are set to the inverse of their required states, whereby the second stage operates substantially to cancel charge imbalances applied across individual pixels in the first stage.

The inventional further provides a method of co-ordinate refreshing a liquid crystal cell that includes a liquid crystal layer which by the application of oppositely directed electric potential differences across the thickness of the layer is enabled to be switched between two states, which cell is switchable between said two states using an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer, wherein each time the pixels of the co-ordinate array are refreshed such refreshing is performed in two sequential stages that co-operate to preserve substantial charge balance across each individual pixel of the array, in one of which stages the pixels are set to their required states, and in the other of which stages the pixels are set into their opposite states.

Individual pixels scheduled for refreshing into one state may be set into that state by applying to their electrode pads a potential of +V/2 with respect to the potential of the front-plane electrode. Similarly, pixels scheduled for refreshing into the other state may be set into that other state by applying to their electrode pads a potential −V/2. The application of these potentials necessarily creates a charge imbalance across individual pixels, and if refreshing were to be carried out as a single operation not involving the setting up of the inverse display in which all pixels are set to the opposite of their scheduled states, it is evident that repetitive refreshing in which any given pixel is consistently set to the same state is necessarily going to give rise to cumulative charge imbalance.

Cumulative charge imbalance is also going to similarly arise if the single stage refreshing (that does not involve the setting up of the inverse display) is performed by a refreshing operation that commences with a blanking operation in which the potential of the electrode pads of all pixels are taken to a potential +V with respect to the front-plane electrode prior to taking the potential of the electrode pads of selected pixels to a potential −V with respect to the front-plane electrode.

The problem of cumulative charge imbalance is however capable of being overcome by adopting the two stage refreshing process of the present invention in which a stage that involves the setting up of the pixels into their required states is preceded or followed by a stage in which they are set up into states that are the inverse of the required states. In utilisation of the device, use may be confined to those periods in which the 'required states' display is being displayed, or use may also be made of the periods in which the 'inverse' display is being displayed, taking additional steps to invert the inverse.

There follows a description of back-plane co-ordinate addressed liquid crystal devices and their method of operation embodying the invention in preferred forms. The description refers to the accompanying drawings in which.

Figure 1:
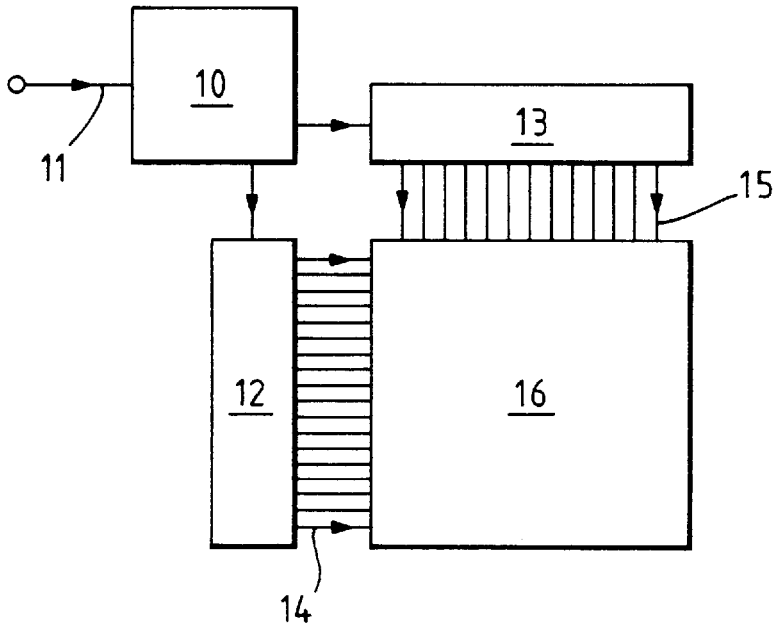
FIG. 1 is a block-diagram of a back-plane co-ordinate addressed liquid crystal device.
Figure 2:
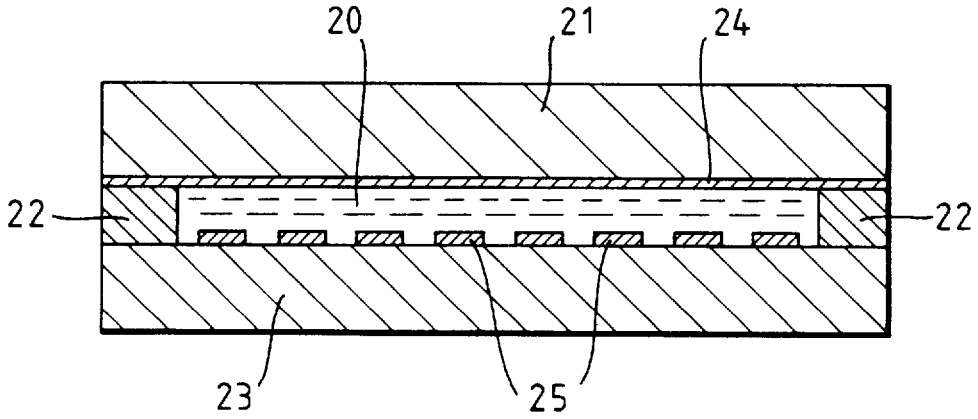
FIG. 2 depicts a schematic cross-section of the liquid crystal cell of the device of FIG. 1.

Referring to FIG. 1, a data processor 10 receives incoming data over an input line 11, and controls the operation of row and column addressing units 12 and 13 which provide inputs on lines 14 and 15 to the electrodes of a back-plane co-ordinate addressed liquid crystal cell 16 with pixels arranged in a co-ordinate array of n rows and m columns. In this cell 16 a hermetic enclosure for a liquid crystal layer 20 (FIG. 2) is formed by securing a transparent front sheet 21 with a perimeter seal 22 to a back sheet 23. Small transparent spheres (not shown) of uniform diameter may be trapped between the two sheets 21 and 23 to maintain a uniform separation, and hence uniform liquid crystal layer thickness. On its inward facing surface, the front sheet 11 carries a transparent electrode layer 24, the front-plane electrode layer, while a co-ordinate array of pixel pad electrodes 25 are similarly carried on the inward facing surface of the back sheet 23. These two inward facing surfaces are treated to promote a particular molecular alignment of the liquid crystal molecules in contact with these surfaces in the same direction. The back sheet 23 constitutes an active back-plane, by means of which the pixel pads 25 may be individually addressed on a row by row basis. Within its active structure, which may for instance be constructed in single crystal silicon, it contains the row and column addressing 12 and 13 units (FIG. 1), and may additionally contain the data processor 10. The area of overlap between the front-plane electrode layer 24 and an individual pixel pad 25 defines a pixel of the cell. The liquid crystal layer 20 is composed of a ferroelectric chiral smectic C material. The thickness of the layer 20 is equal to an odd number of quarter wavelengths divided by the birefringence of the liquid crystal material, and it is viewed through a polariser (not shown).

The application of a potential difference in one direction across the thickness of the chiral smectic C phase layer 20 will promote alignment of the liquid crystal molecules in a direction inclined at an angle $\emptyset$ with respect to the parallel surface alignment directions, where $\emptyset$ is the tilt angle of the chiral smectic phase. A reversal of the potential difference will change the promoted molecular alignment to the angle $-\emptyset$ with respect to the parallel surface alignment directions. However in may instances significant relaxation of alignment occurs upon removal of the switching potentials, in which case the visual contrast that remains after full relaxation has been allowed to occur is liable to be significantly worse than that available before any appreciable relaxation has been allowed to occur. In order to avoid the problems presented by those relaxation effects, the cell is observed while the potential differences, established across the pixels to set them into their required states, are still maintained.

Figure 3:
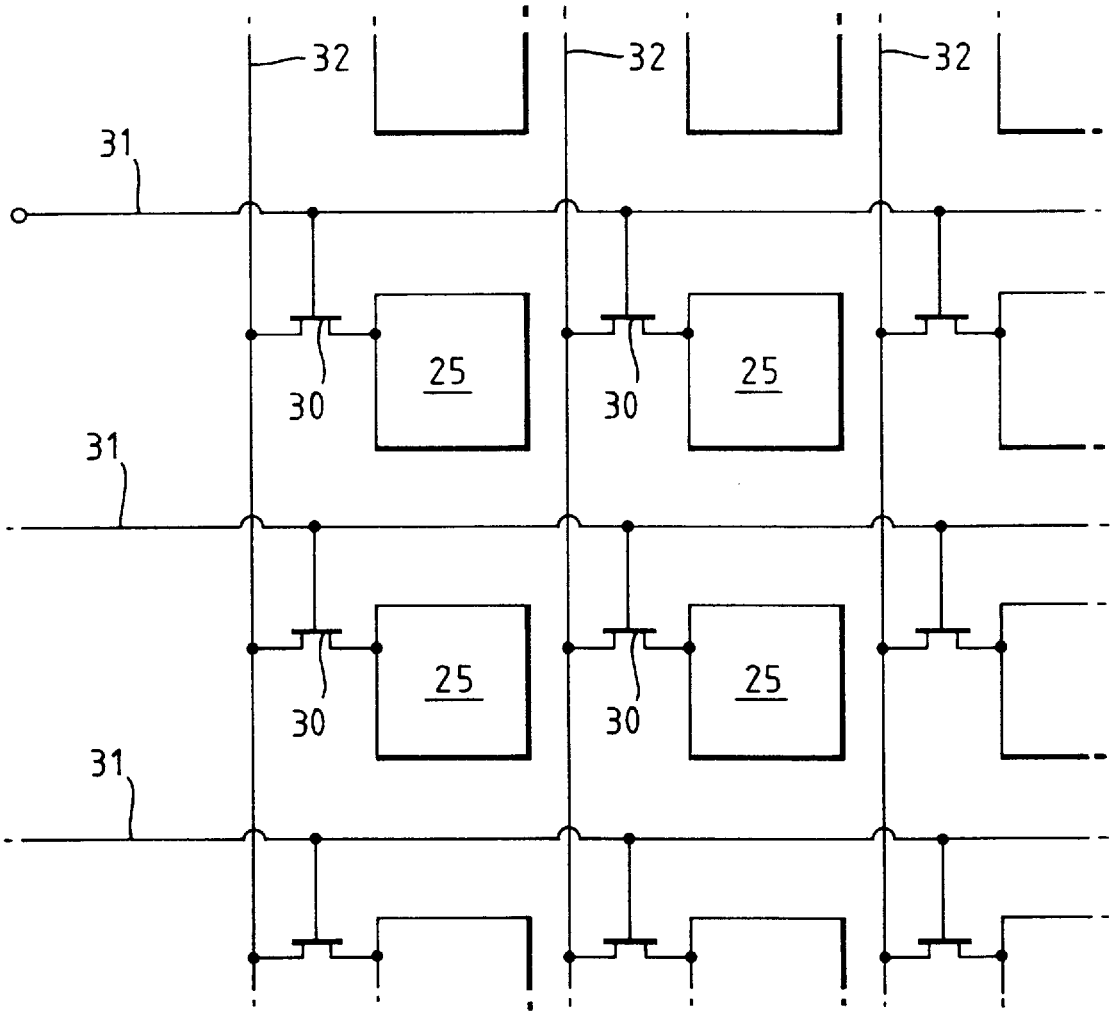
FIG. 3 is a diagram of the pixel pad addressing arrangement.

Referring now to FIG. 3, a single gate 30 is associated with each pixel electrode pad 25. All the m gates of a row of pixel electrode pads are enabled by the application of a suitable potential to a row electrode 31 associated with that row. The gates 30 are enabled in row sequence using a strobing pulse applied in turn to the n row electrodes 31 from the row addressing unit 12. Enablement of each row of gates 30 serves to connect each pixel electrode pad of that row with an associated column electrode 31 connected to the column addressing unit 13.

Refresh rows of data are entered in row sequence into a single bit m-stage shift register (not separately illustrated) in the column address unit 13 under the control of the data processor 10. Associated with each stage of the shift register is a logic unit (not separately illustrated) which determines whether the associated column electrode 32 shall be connected to a voltage rail (not separately illustrated) held at a potential +V/2 with respect to the potential of the front-plane electrode 24, or to a voltage rail (not separately illustrated) held at a potential −V/2. While the refresh line of data is held in the shift register, the data processor 10 causes the row address unit to supply a strobe pulse to the relevant row electrode 31. This temporarily enables the gates 30 of that row so that its pixel electrode pads 25 are charged to potentials +V/2 and −V/2 according to the data currently stored in the shift register. At the end of the strobe pulse, the gates 30 are restored to their disabled condition and hence, neglecting leakage effects these potentials remain upon the pads until these gates are once again enabled. Since the potentials remain on the pads, the duration of a strobe pulse needs only to be long enough to allow the pads to charge up to their requisite potentials, and does not need to be maintained for generally significantly longer period that is required to produce the necessary optical response in the liquid crystal.

When all the rows of the array have been refreshed, and sufficient time has elapsed since the strobing of the last row to enable the pixels to have responded, the cell is ready to be observed, and the first stage of the refreshing has been completed. The second stage is a repetition of the first stage, but with the inverse data for each row being entered from the data processor 10 into the shift register. Thus, though pixels in different rows have potentials applied across them for different periods of time according to how high up or low down they are in the strobing sequence, each individual pixel is subjected to a potential difference for a certain period of time special to that row, first in one direction, and then later, for an equal period of time, to an equivalent oppositely directed potential difference.

At the end of the second stage of refreshing a new cycle of refreshing is immediately commenced, or alternatively all the pixel electrode pads 25 are discharged to the potential of the front plane electrode 24. It will be apparent that it is equally valid to enter the inverse states in the first stage of refreshing, rather than the second, always provided that the required states are entered in the second stage, rather than the first.

In the foregoing specific description it has been tacitly assumed that the front-plane electrode 24 is at all times maintained at a constant potential, and that the voltage rails of the column address unit are maintained equally positive and negative with respect to that fixed voltage. If the construction of the back-plane sheet 23 is such that it is able to drive pixel electrode pads 25 within the voltage range from 0 volts to V volts, then, if the front-plane electrode is to be maintained at a fixed potential, the fixed potential is preferably V/2 so as to allow a maximum potential difference of +V/2 or −V/2 to be developed across any pixel. A larger potential difference can be developed if the potential of the front-plane electrode is allowed to change. Thus, for instance if the front-plane potential were set to 0 volts, a potential difference of +V can be developed across any pixel selected. It is of course impossible to develop the oppositely directed potential difference under these conditions, and so pixels can be set in one direction only. This can be tolerated if each stage of the refreshing commences with a blanking in which all pixels of the array are set in the other direction. For this blanking of all pixels, the front-plane electrode needs to be set to +V, and all the pixel electrode pads need to be set to 0 volts. In this blanking it is preferable to arrange for pixels to be blanked simultaneously with the aid of a pulse applied simultaneously to all row electrodes 31, but row sequential blanking of all rows is in some circumstances an acceptable alternative. Once blanking has been accomplished in the first stage of refreshing, the front-plane electrode potential is changed from +V to 0 volts ready for selected pixels to be set to the opposite state row-by-row in the continuation of this stage. At the end of the first stage of refreshing the second stage commences with blanking all the pixels by setting them all to the same state as the selected pixels, then, with the front-plane electrode potential once again restored from 0 volts to +V, the second stage continues with the setting row-by-row of the selected pixels back to the other state.

One particular application for these back-plane co-ordinate addressed liquid crystal devices is as the active element of a matrix vector multiplier, for instance for use as an optical cross-bar switch. In such a matrix vector multiplier a columnar array of n optical sources is optically arranged relative to the pixels of the co-ordinate array of the cell so that the $p^{th}$ element of the column of sources is optically coupled with all m pixels of the $p^{th}$ row of the co-ordinate array, while similarly a row array of m optical detectors is optically arranged relative to the pixels so that all n pixels of the $r^{th}$ column of the co-ordinate array are optically coupled with the $r^{th}$ element of the row of detectors. Conveniently a polarisation beam splitter is employed in the optical coupling of the sources and detectors with the co-ordinate array in order to provide the dual function of separating the input and output beams and of providing the necessary polariser for operation of the device.

Figures 4A, 4B, 4C, 4D:
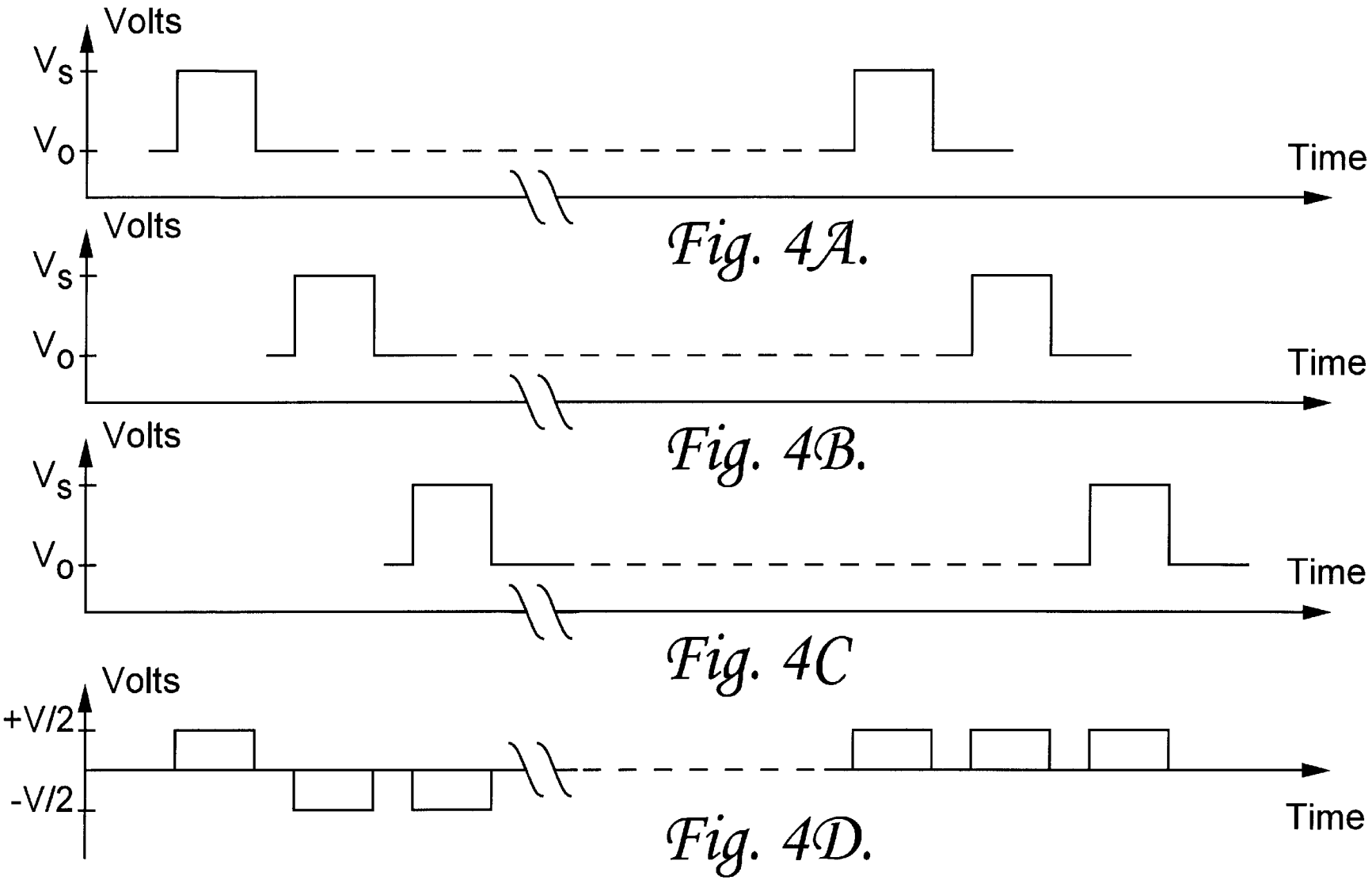
FIGS. 4A–4D illustrate driving waveforms for driving the liquid crystal cell.

Examples of driving waveforms for driving the liquid crystal cell are given in FIGS. 4A, 4B, 4C and 4D, in which FIGS. 4A, 4B and 4C illustrate strobing pulses applied respectively to terminals 31 associated with the pixel pads of row n, of row (n+1) and of row (n+2). These strobing pulses switch the gate electrodes of FETs 30 between an open-circuit condition provided by the application of a voltage $V_o$ and a short-circuit condition provided by the application of a voltage $V_s$. The waveform of FIG. 4D is the data waveform applied to a particular column electrode 32, by the way of example the column electrode associated with pixels of column r. The voltage of +V/2 with respect to the front plane electrode sets the addressed pixel into the data 1 state, and correspondingly the voltage of −V/2 sets it into the data 0 state. Accordingly these particular waveforms illustrated in FIGS. 4A to 4D serve initially to set the pixels of column r and rows n, (n+1) and (n+2) respectively into their data 0, data 1 and data 1 states, while in the next addressing these pixels are all set into their data 1 states.

We claim:

1. A method of addressing a liquid crystal cell whose response to an electrical stimulus is sensitive to the polarity of that stimulus, which cell has a co-ordinate array of pixels, wherein data for refreshing the cell is applied at each refreshing in two sequential states in one of which all said pixels are individually set to their required optical appearance states and in the other of which all said pixels are set to the inverse of their required states, wherein said first sequential stage provides net transfer of charge across individual pixels, which net transfer of charge is substantially cancelled pixel by pixel by net transfer of charge across individual pixels provided in said second sequential stage.

2. A method of co-ordinate refreshing a liquid crystal cell that includes a liquid crystal layer which, by the application of oppositely directed electric potential differences across the thickness of the layer, is enabled to be switched between two optical appearance states, which cell is switchable between said two states using an active back-plane provided by a co-ordinate array of electrode pads on one side of the liquid crystal layer, which pads co-operate with a front-plane electrode on the other side of the liquid crystal layer to define an associated co-ordinate array of pixels within the liquid crystal layer, wherein each time the pixels of the co-ordinate array are refreshed such refreshing is performed in two sequential stages, wherein said first sequential state provides net transfer of charge across all the individual pixels of said array, which net transfer of charge is substantially cancelled pixel by pixel by net transfer of charge across the thickness of the liquid crystal layer at individual pixels provided in said second sequential stage, whereby the two stages co-operate to preserve substantial charge balance across each individual pixel of the array, and whereby in one of which stages all said pixels are set to their required states, and in the other of which states all said pixels are set into their opposite states.

3. A method as claimed in claim 1 wherein each of said stages of refreshing includes accessing the rows of pixels on a row sequential basis.

4. A method as claimed in claim 2 wherein the potential of the front-plane is alternated in each of said stages of refreshing.

5. A method as claimed in claim 2 wherein each of said stages of refreshing includes accessing the rows of pixels on a row sequential basis.

* * * * *